United States Patent [19]

Aurélio

[11] Patent Number: 4,815,948

[45] Date of Patent: Mar. 28, 1989

[54] VIBRATORY PUMP

[76] Inventor: Pastore Aurélio, Av. Angelo Demarchi, 100 Bairro Demarchi - Sbcampo, Brazil

[21] Appl. No.: 94,732

[22] PCT Filed: Nov. 18, 1986

[86] PCT No.: PCT/BR86/00022

§ 371 Date: Jul. 21, 1987

§ 102(e) Date: Jul. 21, 1987

[87] PCT Pub. No.: WO87/03342

PCT Pub. Date: Jun. 4, 1987

[30] Foreign Application Priority Data

Nov. 21, 1985 [BR] Brazil ..... 8505973[U]
Apr. 24, 1986 [BR] Brazil ..... 8602109[U]

[51] Int. Cl.[4] ..... F04B 35/04; F04B 21/02
[52] U.S. Cl. ..... 417/413; 417/566
[58] Field of Search ..... 417/417, 412, 413, 240, 417/241, 566

[56] References Cited

U.S. PATENT DOCUMENTS

| | | | |
|---|---|---|---|
| 2,634,684 | 4/1953 | Aluarez et al. | 417/413 |
| 2,732,806 | 1/1956 | Aluarez et al. | 417/413 |
| 4,568,250 | 2/1986 | Falk | 417/417 |

FOREIGN PATENT DOCUMENTS

| | | | |
|---|---|---|---|
| 1254050 | 1/1961 | France | 417/413 |
| 595658 | 8/1958 | Italy | 417/417 |
| 1254528 | 6/1968 | U.S.S.R. | 417/240 |
| 1222905 | 4/1986 | U.S.S.R. | 417/241 |
| 1254208 | 8/1986 | U.S.S.R. | 417/241 |

*Primary Examiner*—William L. Freeh
*Attorney, Agent, or Firm*—Michael J. Striker

[57] ABSTRACT

A vibratory pump comprises a skeleton composed by an interior part and an exterior part interlinked by a connection with a movable static bobbin covered with resin that acts on a main membrane that in cooperation with a skeleton delimits a variable volume repression chamber communication with the exterior part through an admission central valve and also acts with a repression duct.

9 Claims, 3 Drawing Sheets

"C"

VIBRATORY PUMP

BACKGROUND OF THE INVENTION

This invention relates to a vibratory pump applicable to pump liquids.

A vibratory pump is known, which includes a housing of synthetic material and formed of a lower part and an upper part linked to each other by means of a connection which is formed in the lower part, an axial oscillating member and a static electric bobbin covered with resin and acting on a movable electric bobbin, which is placed in the axial oscillating member. The middle region of the oscillating member is supported and slides in a bearing and has a flexible membrane, which is disposed near the periphery of the housing in which the axial oscillating member is positioned. The latter supports a cupped glass element which is in cooperation with the flexible membrane. A part of the housing defines a variable volume chamber which communicates with the exterior through an admission valve and with an outer tube. The valve is constituted by a central chamber, which communicates with the variable volume chamber, through a movement of the cupped glass element positioned in the extremity of the axial member, and with the exterior through the opening. A second cupped glass is positioned on the wall of the valve.

In the conventional structure of the pump, the fixed electric bobbin is placed in the interior of the housing and covered with resin; under these conditions the bobbin warms up to the level which is above optimal level.

SUMMARY OF THE INVENTION

It is an object of the present invention to provide an improved vibratory pump.

This and other objects of the invention are attained by a pump in which the static part of the bobbin is positioned in a water refrigeration chamber which ensures the maintenance of the temperature of the bobbin within the acceptable limits.

In the conventional pump of the foregoing type the adjacent extremities of the housing are linked to each other by the connection of external flanges to each other. This solution requires, however, an enormous number of screws to be tightened and untightened each time it is necessary to open or close the pump in the maintenance work and the like; such operation is considered to be annoying and should be eliminated.

Furthermore, the main membrane in the conventional pump is formed by an extension that projects from the lower part of the water chamber to a connection region between the upper and lower parts of the housing, where a flange is coupled to a profiled tooth of the upper part and a flange of the bearing of the central oscillating member, which is interconnected between the flanges of the parts of the housing.

It is another object of the invention to substantially simplify maintenance operations for the vibratory pump.

These and other objects of the invention are attained by a vibratory pump, comprising a housing being substantially cylindrical, said housing including an upper part and a lower part connected to each other; connection means for connecting said lower and upper part to each other; a static electric bobbin covered with resin; a movable electric bobbin on which said static electric bobbin acts; an axial oscillating member supporting said movable bobbin; a bearing supporting said oscillating member; a main membrane supported on said oscillating member and having a periphery set close to an internal face of the housing and in cooperation with the housing defining a variable volume chamber, said lower part of the housing having a cooling chamber filled with water and accomodating said static electric bobbin; an admission central valve connected to said chamber and also to means which provides the cooling chamber with water; a stainless steel membrane having a periphery set in an internal face of said lower part of the housing and positioned between the static electric bobbin and the movable electric bobbin, said lower part having openings which are in communication with the said cooling chamber and with an exterior of the pump, said connection means including a flange region formed in the lower part of the housing and a flange formed on the upper part of the housing, said flange region being spaced from a wall of the upper part by an annular space, a profiled ring accomodated in said space near said flange and coupled to the said flange region by thread means and said ring having on a face thereof a plurality of circular grooves; and a plurality of radial triangular wings circumferentially spaced from each other.

The main membrane may have a profiled flange which is fixed between a tooth formed on the upper part of the housing and a ring which is disposed on the bearing of the oscillating member.

The static electric bobbin may have a cover fixed in the lower part of the housing by ultrasonic soldering.

The admission valve may include an assembly ring provided with a screw thread screwed in an internal surface of the upper part of the housing and a flexible rubber ring having an internal rim, said assembly ring having an external rim on which is set the internal rim of a flexible rubber ring, said upper part having openings for water entry to said chamber, said rubber ring being adapted to cover said openings.

The assembly ring may have an internal rim and an elongated cup-shaped portion co-axial to the assembly ring and having a central opening, and further including a rubber cup-shaped membrane and a pin received in said opening, said membrane being received and adjusted in an internal part of the cup-shaped portion of the assembly ring; said membrane having a lateral wall which covers a wall of the portion of the assembly ring, through which water contained in the chamber flows to an outlet of the pump.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
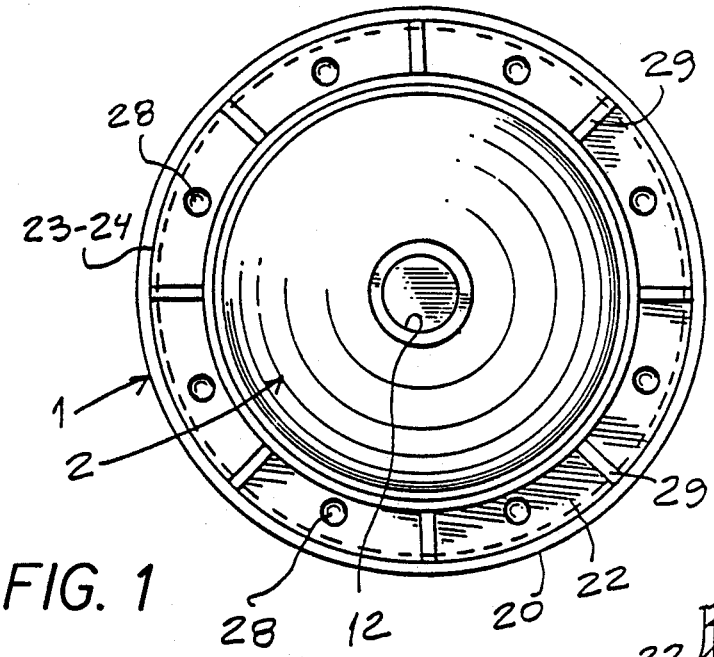
FIG. 1 is a top plan view of the pump.

Referring now to the drawings in detail, a vibratory pump of this invention includes an essentially cylindrical housing made of synthetic material or the like and having a lower part 1 and an upper part 2 connected to each other by means of connection 3. Housing 1, 2 accommodates in its lower part 1, a static electric bobbin 4 covered with synthetic resin 5. Bobbin 4 acts on a movable bobbin 6 positioned in the interior extremity of an oscillating member 7. The latter is disposed axially in the housing 1, 2. Oscillating member 7 is capable of sliding in a bearing 8 supported between parts 1 and 2 of the housing. The oscillating member 7 is supported by a main membrane 9 which limits, in cooperation with the upper part of the housing, a chamber of variable volume 10 which communicates with a central admission valve 11 and with a duct 12; the admission valve has a chamber communicating through opening 14 with the chamber of variable volume 10 in which a flexible cupped glass element 13 is positioned. A second upper cupped glass element 15 which acts on the opening 14 is positioned on the wall defining the admission valve chamber.

The first embodiment of the vibratory pump includes a refrigeration chamber 16. The lower part 1 of the housing is divided by a stainless steel membrane 17 which is disposed between the static electric bobbin 4 and the movable electric bobbin 6. Membrane 17 separates an upper region or chamber from refrigeration chamber 16. The latter is filled with water which surrounds the static electric bobbin 4 and communicates with exterior by means 19.

Figure 4:
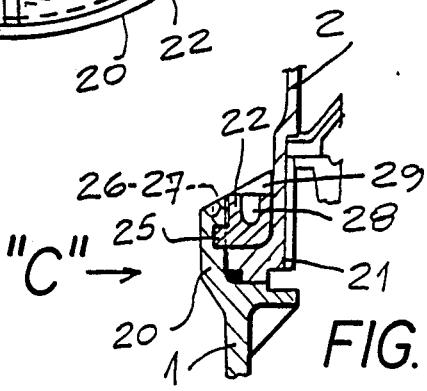
FIG. 4 shows a section B—B of FIG. 3 and illustrates connection means between the parts of the housing in further detail.
Figure 3:
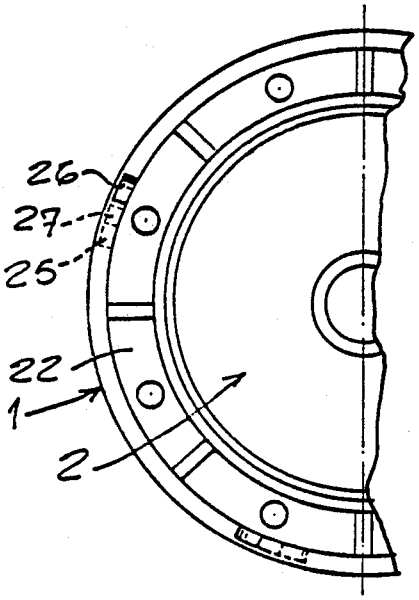
FIG. 3 is a plan view of a detail of connection means between two housing parts.
Figure 5:
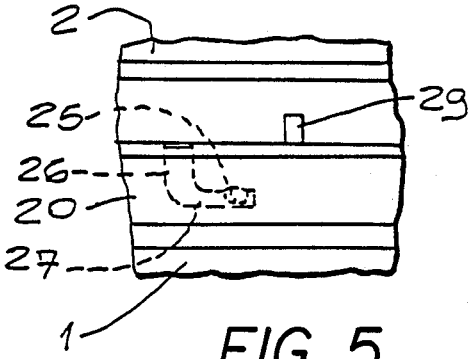
FIG. 5 shows a view from arrow C of FIG. 4.
Figure 2:
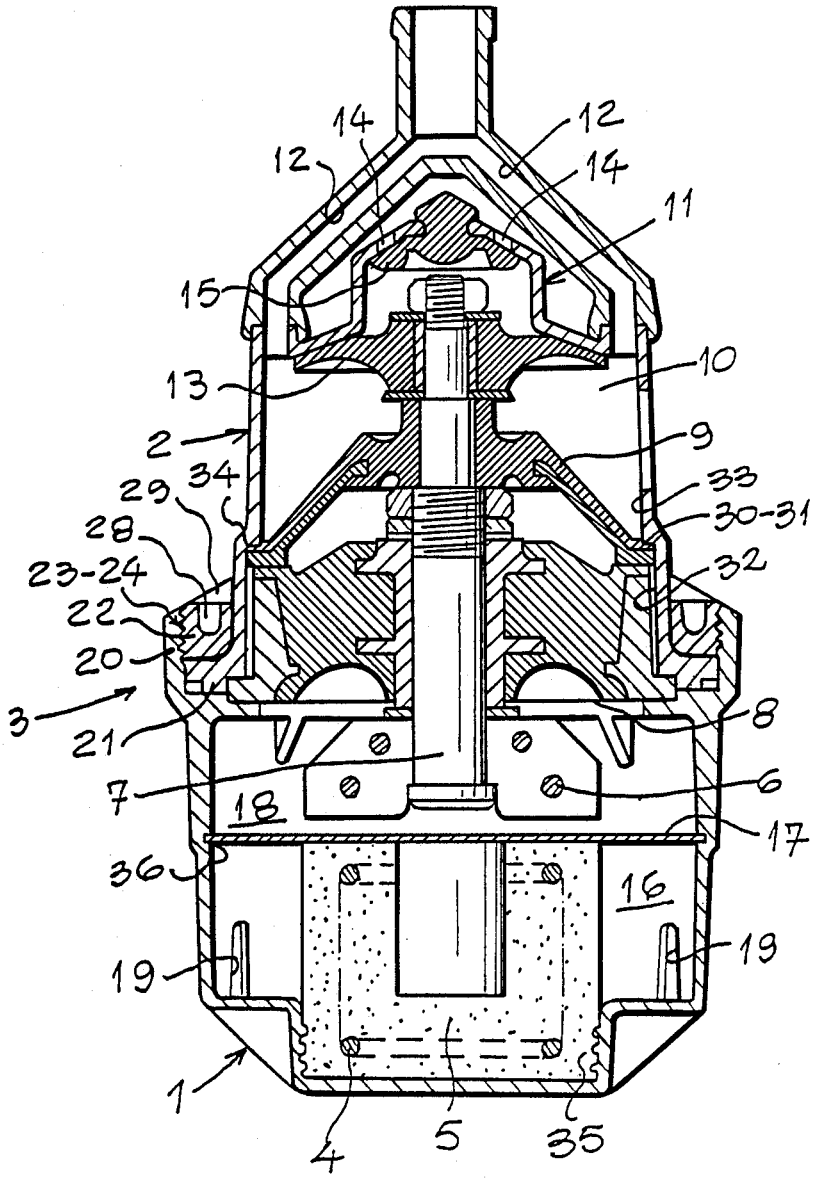
FIG. 2 is an axial sectional view through the pump.

The connection 3 between the lower part 1 of the housing and its upper part of 2 is formed by a relatively short portion 20 of the lower part 1 in which an external flange 21 of the upper part of the housing is fitted. Flange 21 is formed so that a space is formed between the external surface of the upper part 2 of the housing near the flange and the internal surface of the portion 2. A ring 22 is received in this space. Flange 20 is coupled to ring 22 by a screw thread 23. Connection 3 can alternatively be formed by radial pins 25 (FIG. 4) which are projections extending from the ring external face. Pins 25 are engaged in corresponding grooves 26 formed in the internal face of the portion 20. These grooves 26 have the "L" shape and have each a portion extending in longitudinal direction of the pump and a perpendicular region 27 in the circumferential part of the housing.

The profiled ring (22) is provided with grooves 28 (FIGS. 1, 4) and has radial triangular vanes 29 responsible for the ring movement in the opening and closing operations.

The vibratory pump further includes a main membrane 9 which is formed with a profiled flange 30–31 which is clamped between a tooth formed on a part 33 of the upper part 2 of the housing and a ring 34 which is positioned on a bearing of the oscillating member 7.

The resin cover 5 of the static electric bobbin 4 is connected to housing parts 1, 2 by ultrasound soldering or other means 35 and it can be substituted by electrostatic covering to enlarge the refrigeration area. Membrane 17 as well as other structural parts are fixed in the housing, for example by auto-gluing means 36.

Figure 6:
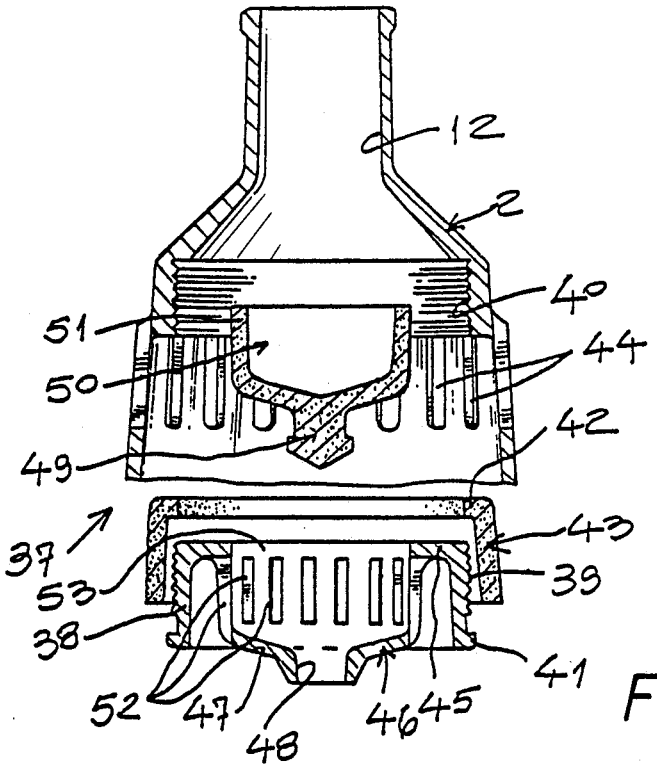
FIG. 6 is a sectional view of the admission and emission valve of the vibratory pump with separated parts.
Figure 7:
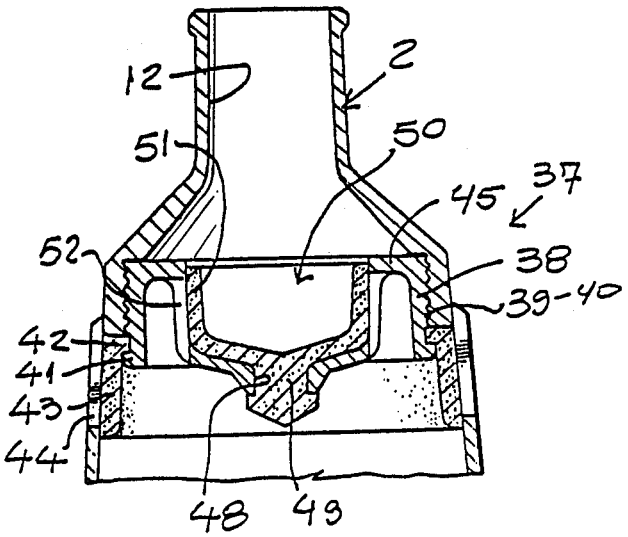
FIG. 7 is a sectional view of the valve in the assembled condition.

The admission valve 11 may be formed as valve 37 (FIGS. 6 and 7). Valve 37 has a ring 38 which is provided with a screw thread 39 that is screwed in a corresponding screw thread 40 formed in an outlet portion 12 of the housing part 2. The ring 38 has an external rim 41 on which in assembly is positioned an internal rim 42 of a membrane 43 of a flexible rubber ring type. Openings 44 in the upper housing part serve for the entry of water into the variable volume chamber 10.

An internal rim 45 is provided on ring 38. A cup-shaped region 46 co-axial to the assembly ring 38 has a projection 47 which has a central opening 48 in which a pin 49 of a cup-shaped flexible rubber membrane 50 is received. Pin 49 is adjusted in the internal region of portion 46 of the assembly ring 38; the flexible rubber membrane 50 has a peripheral wall 51 which covers openings 52 which are formed in the wall 53 of the cup-shaped portion 46 of the assembly ring 38, through which openings water contained in the chamber 10 passes to the outlet of the pump.

When the axial oscillating member 7 of the pump is lowered it enlarges the volume of chamber 10 and causes a depression in the internal part of the chamber, which in turn causes the flexible rubber ring 43 to open the openings 44 and the consequent entry of a portion of water into the chamber 10 and simultaneously, causes the compression of wall 51 of flexible rubber membrane 50, which wall meets the outlet openings 52 of the water chamber 10, and closes those openings.

When the axial member 7 ascends it reduces the capacity of the chamber and causes the compression of the flexible rubber ring 43 which meets the openings 44 which are closed, and simultaneously causes the compression of the flexible rubber ring 50 which opens the openings 52 through which a part of water of the chamber 10 passes to the outlet or duct 12.

It will be understood that each of the elements described above, or two or more together, may also find a useful application in other types of vibratory pumps differing from the types described above.

While the invention has been illustrated and described as embodied in a vibratory pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Vibratory pump, comprising a housing being substantially cylindrical, said housing including an upper part and a lower part connected to each other; connection means for connecting said lower and upper part to each other; a static electric bobbin covered with resin; a movable electric bobbin on which said static electric bobbin acts; an axial oscillating member supporting said movable bobbin; a bearing supporting said oscillating member; a main membrane supported on said oscillating member and having a periphery set close to an internal face of the housing and in cooperation with the housing defining a variable volume chamber (10), said lower part of the housing having a cooling chamber (16) filled with water and accommodating said static electric bobbin; an admission central valve connected to said chamber and also to means which provides the cooling chamber with water (16); a stainless steel membrane (17) having a periphery set in an internal face of said lower part of the housing (1) and positioned between the static electric bobbin (4) and the movable electric bobbin (6), said lower part having openings (19) which are in communication with the said cooling chamber and with an exterior of the pump, said connection means including a flange region (20) formed in the lower part of the housing (1) and a flange (21) formed on the upper part of the housing (2), said flange region (20) being spaced from a wall of the upper part by an annular space, a profiled ring (22) accommodated in said space near said flange (21) and coupled to the said flange region (20) by thread means (23) and (24), said ring having on a face thereof a plurality of circular grooves (28); and a plurality of radial triangular wings (29) circumferentially spaced from each other.

2. Vibratory pump as defined in claim 1, wherein the main membrane (9) has a profiled flange (30) which is fixed between a tooth (31) formed on the upper part of the housing and a ring (34) which is disposed on the bearing (8) of said oscillating member (7).

3. Vibratory pump as defined in claim 1, wherein the static electric bobbin (4) has a cover (5) fixed in the lower part (1) of the housing by ultrasonic soldering.

4. Vibratory pump as defined in claim 1, wherein said connection means further include radial pins (25) formed on said flange (21) and extending towards an external face of the flange region (20), said region having grooves (26–27) which accommodate said pins and are of L-shape, each group having a portion (26) which is disposed in a longitudinal direction of the pump and has a perpendicular portion (27) which extends in a circumferencial direction of the housing.

5. Vibratory pump as indicated in claim 3 described by the fact of the maim membrane (9) be fixed by a profiler flange (30) of the said maim membrane (9) that is intercalated between the tooth (31) composed between the longer (32) and the shorter (33) region of the part of the superior skeleton (2) and a ring (34) which is disposed on the bearing (8) of sustentation oscillating member (7).

6. Vibratory pump as defined in claim 1, wherein the admission and emission valve (37) includes an assembly ring (38) provided with a screw thread (40) screwed in an internal surface of the upper part of the housing and a flexible rubber ring (43) having an internal rim (42), said assembly ring (38) having an external rim (41) on which is set the internal rim (42) of a flexible rubber ring (43), said upper part having openings (44) for water entry to said chamber (10), said rubber ring (43) being adapted to cover said openings.

7. Vibratory pump as defined in claim 6, wherein said assembly ring (38) has an internal rim (45) and an elongated cup-shaped portion (46) co-axial to the assembly ring and having a central opening (48), and further including a rubber cup-shaped membrane (50) and a pin (49) received in said opening (48), said membrane (50) being received and adjusted in an internal part of the cup-shaped portion (46) of the assembly ring; said membrane (50) having a lateral wall (51) which covers a wall (53) of the portion (46) of the assembly ring, through which water contained in the chamber (10) flows to an outlet (12) of the pump.

8. Vibratory pump as defined in claim 1, wherein said thread means (23 and 24) are formed by screw threads respectively provided in an external face of the profiled ring (22) and an internal face of said flange region (20).

9. Vibratory pump as defined in claim 1, wherein said housing is made of synthetic material.

* * * * *